United States Patent [19]

Bass et al.

[11] Patent Number: 4,993,985

[45] Date of Patent: Feb. 19, 1991

[54] ANTI-COLLISION TOY VEHICLE PLAYSET

[75] Inventors: Sidney Bass, Los Angeles; Harold E. Garner, Long Beach, both of Calif.

[73] Assignee: Universal Product Innovations, Inc., Carson, Calif.

[21] Appl. No.: 471,438

[22] Filed: Jan. 29, 1990

[51] Int. Cl.[5] ..... A63H 33/26; A63H 17/00

[52] U.S. Cl. ..... 446/133; 446/465

[58] Field of Search ..... 446/129, 131–139, 446/431, 465; 273/1 M, 239

[56] References Cited

U.S. PATENT DOCUMENTS

| | | | |
|---|---|---|---|
| 2,540,216 | 2/1951 | Quinby | 446/45 |
| 2,630,765 | 3/1953 | Small | 104/148 |
| 2,645,878 | 7/1953 | Johnson | 446/45 |
| 2,842,896 | 7/1958 | Sire | 446/238 |
| 3,303,606 | 2/1967 | Mann | 446/241 |
| 3,711,991 | 1/1973 | Orfei | 48/236 |
| 3,965,613 | 6/1976 | Saunders | 446/238 |
| 4,068,392 | 1/1978 | Montgomery et al. | 446/129 X |
| 4,568,300 | 2/1986 | Rasmussen et al. | 446/129 |

FOREIGN PATENT DOCUMENTS

| | | | |
|---|---|---|---|
| 936377 | 12/1955 | Fed. Rep. of Germany | 446/133 |

*Primary Examiner*—Mickey Yu

*Attorney, Agent, or Firm*—Ronald M. Goldman

[57] ABSTRACT

A children's toy car playset contains at least two toy cars, suitably containing low friction wheel and axle structures. Each of the cars contains an anti-collision device that in normal play prevents collisions between the cars, irrespective of the angle of approach at which one of the cars moves toward an other. Suitably the anti-collision device is formed by a permanent magnet with the magnetic fields oriented so that the field lines extend downwardly at least about the periphery of the car.

15 Claims, 1 Drawing Sheet

ANTI-COLLISION TOY VEHICLE PLAYSET

FIELD OF THE INVENTION

The present invention relates to toy car playsets and, more particularly, to a toy car playset in which the toy cars simulate standard sized cars containing anti-collision devices that prevent two cars from colliding with one another.

BACKGROUND

Toy car playsets have long served as a child's amusement; one through which the child may simulate real life situations through play and thereby learn. Toy car playsets are known in which the toy cars in the set may be linked together to simulate automobile towing. That simulation was accomplished with magnetism; permanent magnets incorporated within the structure of the toy cars that produced an attractive magnetic force between the two. With a magnet mounted in the rear of the towing vehicle being oppositely poled to the pole of another magnet mounted in the front of the towed vehicle, the magnetic attraction between the respective North and South poles of the two magnets forms a magnetic coupling. By pulling on the first or towing vehicle, the towed vehicle maintains physical contact with the towing vehicle and, with the magnetic attractive force produced by the magnets being sufficient to overcome the starting and rolling friction of the towed vehicle, the towed vehicle is pulled right along as if by magic to the child's delight.

Magnetic force has been used as well to simulate an engine in toy cars. With a wheeled car carrying a magnet, a second magnet is moved underneath the car to pull the car along. The two magnets are separated by a magnetically pervious barrier, such as a plastic table top preventing the pulling magnet from coming into contact with the pulled magnet while allowing the invisible magnetic fields to couple. Seemingly the vehicle appears to move on its own power atop a wood table or other magnetically pervious surface as the magnet under the table or surface is moved beneath the car. The child not only played a real life experience, but learned of the attractive force of magnetism as well.

Repelling magnetic forces have also found application in toys as an addition to a toy car structure. That force also provides a form of propulsion and guidance for the toy car such as is found in the patent literature. In U.S. Pat. No. 3,965,613 to Saunders a stick or wand carries a permanent magnet at one end that is positioned by the player near a car containing a relatively small bar magnet located at the cars rear end. The car mounted magnet is oriented at an angle to the chassis bottom and roadway surface, suitably 45 degrees. The magnetic field lines in the Saunders toy car structure may be said to run or extend from the front of the bar magnet to the back, with the magnetic field lines running skew to both the vertical and horizontal axes of the car. The wand carried magnet is poled, either north or south, in the same direction as the adjacent end of the magnet in the rear of the toy car; its north pole located at the tip or end of the bar and its south pole located at the other end. When the wand carried magnet is moved next to the car, the repelling force created by the stick carried magnet, forces the car to roll forward. A like magnet is similarly oriented at the front end of the car disclosed in Saunders to allow the same operation described from the opposite end of the toy car.

Magnetic repulsion has also been used in the toy car educational device described in U.S. Pat. No. 3,711,991 to Orfei, in which U shaped magnets, having the North and South poles located at the tips of the U shape, are mounted in adjacent ends of two cars with the poles of the magnets oriented in the same direction to create a repelling force. A more amusing form of this repelling magnetic effect is presented in the patent to Quinby U.S. No. 2,540,216 that discloses a novelty item in which a railroad engine, propelled in a conventional manner on a railroad track, carries a magnet at the front. The engine runs behind a track car carrying two toy figures, representing workmen, and this track car carries a magnet oppositely poled to that in the engine. The repelling force of the magnet allows the track car to roll along on the track in front of the moving engine, always keeping ahead, simulating a highly motivated effort by the toy figures to avoid being run over by the engine.

Both repelling and attractive magnetic effects have also been combined in a single toy car playset. U.S. Pat. No. 3,303,606 granted to Mann describes toy cars containing small permanent magnets that are rotatably mounted and are of a button or disk shaped geometry, small in size with respect to the size of the toy vehicle. Those magnets contain a central axial opening or passage by means of which the magnets are mounted to the toy cars, with a south pole to one side of the axis of rotation and the north pole at the other side of that axis. Two such magnets are rotatably mounted to each toy car, one at the front and the other at the rear of the vehicle. And the side of the magnets protrude slightly beyond the end of the cars' undercarriage or housing. When a magnet of one vehicle is rotated to a position in which the exposed magnetic pole is the same as the pole of the magnet in an oncoming car the cars will repel. When the disk shaped magnet is rotated 180 degrees about its axis with the other magnet pole facing that in the second car, the cars attract and magnetically couple. Considering the one car to be a tow truck, the tow truck may either push or pull the car for added simulation, depending angular orientation for the magnet selected by the child.

The present invention incorporates magnetism to simulate a collision avoidance effect. The repelling effect of oppositely poled magnets is used in toy cars so as to avoid collisions therebetween. Although the structure described in the Saunders patent is for a players use in propelling and guiding the vehicle, one might imagine if two such toy cars were placed together for play by two different children playing the same game with their respective play sets, and one car approached the other from the front or back, the two cars would likely repel one another and avoid a collision.

In the Saunders structure one such magnet is incorporated at the front of the toy car and a second is incorporated at the cars' rear. Each of the magnets shown is relatively short with respect to the length of the car. Accordingly as one measures the lines of magnetic force at different positions about the periphery of one of the cars, the vehicle the direction of the magnetic field lines changes. Should one car approach another in the playset directly from the front or back, the magnetic fields thus create a repelling force. However, if the one car approached from the other side, so that the north pole of the one vehicle approached the south pole of the other, the two cars would attract and ultimately make contact. And where there was no significant magnetic field along the sides the two vehicles would also make contact. It is recognized that the described characteristics are somewhat speculative since they are unrelated to the function of the Saunders invention in as much as Saunders employs only a single vehicle in the described play set and, consequently, other potential uses or misuses of that structure are not explained.

And with either position of the magnet in the previously described structure presented in the Mann patent, it is apparent that when one car is approached from the side, the two cars may attract or in some instances repel depending upon the position along the side from which the approach is made. The two vehicles cannot repel one another in all directions of approach and thus cannot properly simulate an anti-collision device. By changing the magnet and the configuration of the magnetism, in the simple manner hereinafter taught, in cars such as those presented in the Saunders and Mann patents, a true anti-collision system may be formed. To simulate cars with anti-collision features, the prevention mechanism should protect irrespective of the direction of approach. None of the car structures presented in the foregoing patents appear to provide a repelling force active between cars active in any direction of approach along the roadway surface, over a full 360 degrees about the car.

Fantasy and simulation are enhanced with color and speed. Brightly colored die cast metal cars are typical of existing toy cars that have enjoyed a high percentage of the toy car market for many years. Those cars were cast of iron, which is a magnetic material, or of zinc or zinc alloys, which are non-magnetic materials. A prime reason to their commercial success is the low friction easy rolling wheel axle arrangement, which allows the car to move fast and long; a secondary reason is the cars attractiveness and solid feel. An aspect of the present invention is the incorporation of such easy rolling wheels in a car of essentially plastic and magnet material.

Plastic toy cars of many varieties have been known heretofore. More specifically plastic cars incorporating the high speed low friction wheels were heretofore known, such as was introduced years ago under the "Johnny Lightning" brand name by the Topper Company as a lower cost substitute for die cast metal. However, those plastic cars did not perform well: the weight of the cars was less than that of a comparable size die cast metal car. Consequently when pushed or rolled down a slope, the cars momentum was lower, making a less attractive alternative for the children. To achieve the greater momentums available from the die cast toy cars they were to replace, additional weights had to be added to the plastic structure, destroying the manufacturing cost advantages. Those plastic cars, consequently, were short lived and disappeared from the market years ago in the early '70's.

The present invention takes advantage of the low friction wheels to enhance the effects of repelling magnetic force. None of the magnetically operated toy cars described in the patent literature, earlier described, appear to employ the easy rolling wheel axle arrangements of the die cast metal cars or to offer the dramatic results obtainable from such low friction wheel structures.

An object of the invention, therefore, is to provide a toy car playset that simulates standard automobiles equipped with anti-collision devices.

An additional object of the invention is to prevent collisions between toy cars as one is propelled toward another, irrespective of the direction of approach.

A further object is to provide a toy car playset in which individual vehicles may repel one another on approach over any of 360 degrees of approach.

And an ancillary object of the invention is to provide a low cost easily manufactured easy rolling toy car containing magnets and a plastic body that has both the look and feel of a toy die cast metal car of the kind presently being marketed.

SUMMARY

In accordance with the invention a toy playset contains at least two cars for play on a roadway and anti-collision means are included in the cars for creating a repelling force between the two cars as one approaches the other from any direction along the roadway surface.

The present invention derives from the discovery that the intensity of magnetic force provided by inexpensive magnets, properly configured magnetically, is sufficient to cause such repulsion between toy cars that incorporate a single one of those magnets, irrespective of the direction of approach as causes those toy cars either to move and roll away from one another to a degree not heretofore observed in these kind of toys, or to stop, creating a realistic simulation of automobile anti-collision devices and, consequently, providing superior "play value". The invention is particularly adapted to toy cars of a feel and appearance as those die cast metal cars that presently enjoy market acceptance and integrates well with existing collections of toy cars of that type.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENT

Figure 1:
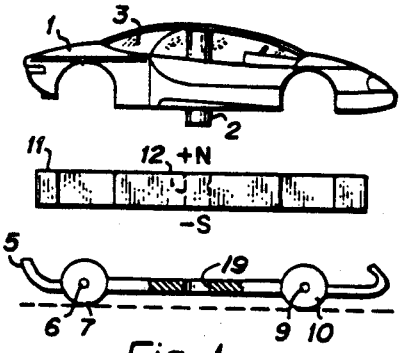
FIG. 1 illustrates a preferred embodiment of the invention in a partially exploded side view.
Figure 2:
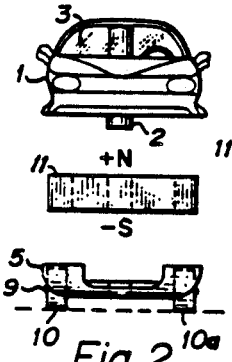
FIG. 2 is a front view of the illustration of FIG. 1.

A preferred embodiment of a toy vehicle according to the invention is illustrated in FIG. 1 in a partial exploded side view to which reference is made. The car includes an upper body portion 1, suitably plastic, a transparent plastic window bubble 3 that fits within the hollow of body portion 1 to form windows, an undercarriage 5 or chassis, a rear axle 6, to which is attached a pair of wheels, including wheel 7 and another wheel on the opposite side not visible in the figure, and a front axle 9, to which is attached a second pair of wheels, including wheel 10 and a second wheel located on the opposite end of the axle not visible in this view. A permanent magnet 11 fits within and is covered by the upper body portion and, preferably, rests on the undercarriage when the car is fully assembled. The long axis of the magnet is oriented so as to be positioned horizontal so as to place the flat bottom and top surfaces of the magnet essentially horizontal, parallel to the flat road surface on which the vehicle is to be rolled as indicated by the dash lines. These same elements are shown in the front exploded view of FIG. 2 in which the second front wheel 10*a* is visible. The body portion is shaped to resemble a standard size vehicle in design in this embodiment. As those skilled in the art appreciate, however, other shapes may be created that are of a more imaginary character without departing from the invention.

A boss or post 2 is integrally formed in the upper body portion. The post extends below the bottom of the upper body portion and is aligned with and extends through a passage or hole 12 in permanent magnet 11, represented in invisible lines in FIG. 1, and a hole 19 in undercarriage 5. When assembled the end of the post is heated and reflowed or ultrasonically welded to form a head so as to effectively fix the component parts into a unitary assembly. The inclusion and use of a fastener such as the post is entirely conventional and appears in many toy vehicles on the market. Other less preferred forms of fastening may of course be substituted or the post fastener arrangement.

The upper body portion 1 and chassis 5 are formed of plastic, suitably ABS plastic of the type used in football helmets that is formed to shape by conventional molding processes, that need not be herein described. ABS plastic, also known by its generic name acrylonitrile butadiene styrene is a commercially available, tough plastic, non-magnetic in characteristic, that may be brightly colored and styled to simulate the look and feel of a die cast metal car. Preferably the body portion and undercarriage or chassis is vacuum metalized, plated, to provide an attractive bright metal exterior finish.

In this preferred embodiment, magnet 11 is a singular pole ferrite magnet and preferably a flexible type extruded or molded magnet containing 97% magnetic ferrite powders held in a vinyl binder, a kind of magnet material commercially available from the "Flexmag" company of Ohio as can be configured in the manner herein described. Such magnet is inexpensive and meets the criteria necessary for use with toy cars, adding little in cost and much in creativity and play value. Standard magnetization intensities as supplied in other magnets provided by that company are suitable and such magnets should be formed in the polarity or magnetic direction prescribed herein. The magnet is magnetized so that its entire top surface is magnetized in one direction, suitably north, and its bottom surface is magnetized in the opposite polarity direction, suitably south.

Figure 3:
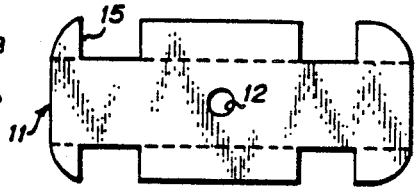
FIG. 3 shows a top view of the magnet used in the embodiment of FIG. 1.

As shown in the top view of the magnet presented in FIG. 3, the magnet, physically, is of a generally rectangular shape with a length that is approximately equal to essentially to the length of the hollow interior of the upper body portion and of a width that is approximately equal to the width of the hollow interior of the upper body portion, allowing in each case for a clearance of perhaps one or two thousandths of an inch. The height, the distance between the top or upper surface of the magnet and the bottom or lower surface, is short, relative to the length and width. By way of specific example the length may be 1.75 inches, the width 0.5 inch and the height 0.25 inches. Desirably the edges of the magnet should extend to the periphery of the inner body portions of the car so as to ensure that the magnetic field generated by the magnet, the invisible field lines, extend external of the cars body with sufficient intensity or strength as to permit the field lines to interact with the field lines of a like car, comparably constructed, to cause one car to repel the other, even when one car is slowly brought into proximity to the other.

In addition to passage 12, the magnet contains four rectangular shaped notches or cut away portions 15, only one of which is labeled, to provide clearance for the four wheels, as may be said to define wheel wells. With such a structure the size of the magnet is such in dimension as to extend to the greatest practical extent to the inner walls of the car body. In less preferred embodiments the magnet may be of a simple rectanguloid shape as indicated by the horizontal dash lines, being limited in width to the width of the body portion less twice the width of the wheel well, so as to avoid contact with the wheels. In still other embodiments in which the wheels are outside the body, representing a fenderless or fantasy vehicle in appearance, the magnets width will be that of the inner portion of the car. It is believed that an isotropic ferrite magnet may be used in such embodiments. The magnet produces magnetic lines of force, not visible to the unassisted eye, that extend through and beyond the body portion and all about the sides of the vehicle. Given the top as north, the magnetic field lines in part extend through the upper surface and extend about the sides of the surface entering from the under side of the car to the opposite magnetic pole.

Should one wish to reduce the weight of the vehicle, that may be conveniently accomplished by enlarging the radius of passage 12. It is found that the radius may be at least doubled in size, eliminating magnetic material without materially affecting the operation; and it is expected that the passage may be increased in size further with no noticeable adverse effect.

The weight of the magnet exceeds the weight of the plastic body portions. Since the geometry of the magnet is elongate and thin and its placement is in the lowermost section of the formed vehicle, the center of gravity of the vehicle lies below the midheight of the car and, preferably, is about at top of the wheel. Thus the toy vehicle has a low center of gravity like that of existing die cast metal cars Unlike die cast iron cars, however, the car's housing or body is non-magnetic, allowing the magnetic field generated by the permanent magnet to permeate and extend through the upper body portion, allowing that magnetic field to interact with the magnetic fields of similarly equipped toy vehicles in the playset. As those skilled in the art appreciate other materials may be substituted for the plastic, even metals, so long as those substitute materials are non-magnetic or otherwise do not shield the magnetic fields generated by the enclosed magnet so as to render the effects of the fields inoperative. Thus in less preferred embodiments the car body may be made from zinc or zinc alloys that are non-magnetic in character as an alternative to the plastic.

Figure 4A:
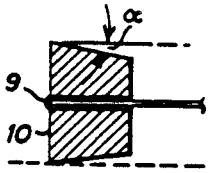
FIG. 4*a* is an enlarged partial section view of a wheel and axle assembly used in the embodiment of FIG. 1

The axle and wheel combination is the same low friction easy rolling fast wheel type wheel axle structures found in presently available toy die cast metal cars, such as found in the "Hot Wheels" and "Matchbox" brand die cast metal cars. An enlarged not to scale partial section view of wheel 10 and axle 9, described earlier in connection with FIG. 1, is presented in FIGS. 4*a*. In this conventional wheel axle construction axle 9 is a straight thin strong stainless steel wire, suitably 0.028 inches in diameter. A light molded plastic wheel 10 having a slightly enlarged central cylindrical axially extending opening therethrough is rotatably mounted to such axle by inserting the wheel onto the end of the rod like shaft and the end of that rod is staked or flattened so as to prevent the wheel from falling off.

Figure 4B:
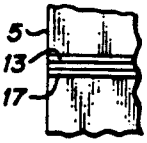
FIG. 4*b* is an enlarged partial section top view of a portion of the chassis showing structure for supporting the axle.

The axle is mounted to the chassis by being dropped in between vertical ribs, 13 and 17, shown in a not to scale enlarged partial section top view for one axle in FIG. 4*b*, molded in the upper surface of the chassis bottom, which form channels extending transverse the width of the chassis, and, in a preferred embodiment, is trapped in place by the magnet, which lays thereover.

Referring again to FIG. 4*a*, the peripheral surface of the wheel, the "simulated tire tread" is tapered inwardly axially at a slight angle to the horizontal, not only to allow for removal from the mold in the plastic wheel fabrication process, but also to allow only a narrow peripheral portion of the wheel to contact the flat surface, such as a track or floor, on which the wheels roll. Thus while presenting the appearance of a thick tire, only a narrow portion of that tire actually touches the surface on which the tire is placed; with minimal contact with the road surface, frictional losses are less than would be the case if the entire surface of the "tire" contacted the roadway. For additional details of that "fast wheel" type structure, one is referred to those commercially available toy vehicles that one may purchase and inspect in detail.

With such low friction construction, by raising the velocity of such die cast metal car, say to V, by giving the car a push, the car can travel faster and further than otherwise would be the case with higher friction type wheel axle arrangements. The car travels until the kinetic energy received in the push, equal to $\frac{1}{2}MV^2$, where MV, the momentum, the cars mass multiplied by the cars velocity, is dissipated through frictional losses, occurring through the axle friction and/or the friction with the roadway or by running into a wall or other barrier. When cars with such low friction axles and wheels were first introduced into the marketplace in the late 1960's, the fast speeds attained by the die cast metal cars was considered revolutionary, delighted young children and resulted in immediate commercial success. This same easy rolling characteristic of the die cast metal cars is employed to advantage in the plastic magnet cars of the present invention.

In the preferred embodiment the magnet is of a length that approximates the length of the car, extending between the front and back ends of the car housing, allowing for the thickness of the body portion; its width likewise extends between the right and left hand side of the car, allowing for the thickness of the covering body, with cut out sections for the wheel wells. This geometry ensures that the magnetic fields are as intense as possible at or beyond the edges of the body portion. In other embodiments that are believed to be less effective, the width is less, extending between the wheel wells, allowing for a straight rectangular shaped magnet of short height.

The magnet is magnetized so as to be a monopole, the upper surface is entirely of one magnetic polarity, suitably a north magnetic polarity, and the opposed bottom surface is entirely of the opposite magnetic polarity, suitably a south pole. The invisible lines of magnetic force created by the magnet extend from the north pole, through the plastic car housing, and about the car through the car bottom or undercarriage to the south magnetic pole. Accordingly, a like magnetic field extends about the periphery of the car, irrespective of whether the car is approached from the front, the back or from the right and left sides or at an angle. Other cars of the set of like structure have the same magnetic field orientation.

Figure 5B:
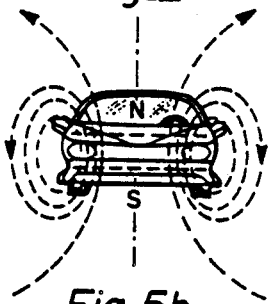
FIG. 5*a* symbolically illustrates a portion of the magnetic field as viewed from the top of the car and FIG. 5*b* illustrates a portion of the field appearing at the cars midsection as viewed from the front side.
Figure 5A:
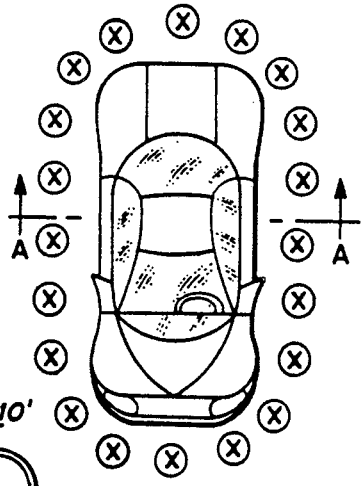

As viewed from the top of the car in FIG. 5*a* at a depth about three quarters of the way down the side of the car, some magnetic lines, symbolically represented, are shown to extend down essentially perpendicular to the plane of the drawing. These magnetic lines of force appear all about the exterior of the car as shown.

By way of further symbolic illustration as viewed from the front of the car magnetic field lines at the cars midsection, taken along lines A—A in FIG. 5*a*, are presented in phantom lines in FIG. 5*b*. With the polarity of the top surface of the magnet being poled North the lines of magnetic field may be said to extend out from the top through and about the car. And a portion of those lines extend through the plastic car body, around the side surface of the car, with vertically extending portions, and then around to the South pole of the magnet at the cars bottom.

As those skilled in the art appreciate, the lines of force may be made visible through use of metal filings on paper or by a special device the latter of which contains minute metal filings in a translucent green colored plastic carrier or sheet form. The device is a thin sheet that may be placed on magnetic material to view the lines of force, avoiding the need of dealing with loose iron filings. This is particularly helpful in the design of the magnet, ensuring that the fields produced fulfill the conditions described for operation as an anti-collision device in the playset. When placed on the top of a vehicle constructed according to the invention, the special device showed a light "halo" surrounding the outer periphery, a dark area within the body, and a less dark area on the outer side of the halo.

As one recognizes the magnet could be magnetized so as to have the north pole at the front end and the south pole at the rear end as in the prior art, as is the conventional approach for a bar type magnet. However, in that instance cars in the playset would in some orientations attract one another, which departs from the purposes of the present invention; although in appearance to the naked eye, the cars constructed according to the invention may resemble those constructed to the prior art, they are not the same. It also should be recognized, however, that to provide variety and additional form of play, a playset that incorporates the invention may also incorporate some toy cars whose magnets are magnetized in the described conventional way taught in the prior art, as for example if one of the vehicles in the playset is to serve as a tow truck. Thus while the invention has obvious advantage alone, by including other known features in additional cars, a playset may be enhanced and, accordingly the use of the invention as a playset should not be construed to exclude additional cars that do not incorporate the invention.

The invention has ancillary advantage. Employment of a single magnet in each vehicle affords obvious manufacturing advantage and is thus more desireable: Fewer parts need be stocked and/or less complex magnetizing equipment is required to fabricate the cars as compared to the magnet arrangements shown in the Saunders and Mann patents.

In one specific example of an embodiment made in accordance with FIG. 1 a car is fifty millimeters in length, twenty millimeters in width and fourteen millimeters in height as measured from the bottom or underside and sixteen millimeters in height as measured from the bottom of the wheel. The thickness of the housing is 0.035 millimeters. The length of the magnet is forty two millimeters, its width sixteen millimeters and its thickness or height is five millimeters. The magnets weight of the magnet is approximately seven grams and the weight of the plastic housing is approximately six grams with the wheels and axles adding an additional gram of weight. The ratio of the weight of the magnet to the weight of all other components of the car was 1:1. The strength of the magnet is 1900 oersteds. The wheel axle is 0.028 inches in diameter and the wheel is of molded plastic of a maximum outer diameter of seven and one-half millimeter inches with the axle being stainless steel, which is a non-magnetic material. Preferably, cars constructed according to the invention is implemented in a 1/100th scale.

Figure 6A:
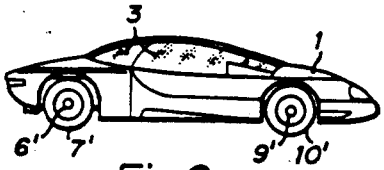
FIGS. 6*a* and 6*b* illustrates an alternative embodiment of the invention in side and bottom views, respectively.
Figure 6B:
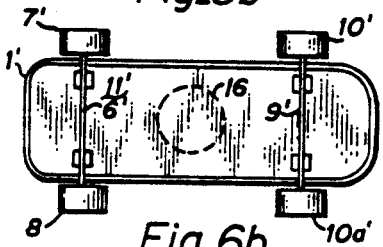
Figure 7A:
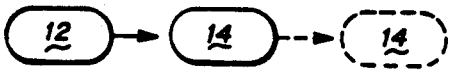
FIGS. 7*a*, 7*b*, 7*c* and 8 illustrate the collision avoidance operation of the preferred embodiment.
Figure 7B:
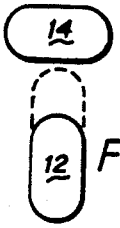
Figure 7C:
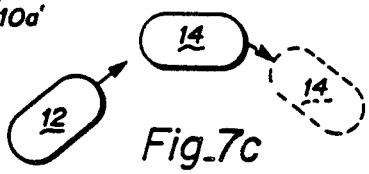

Reference is made to FIGS. 6*a* and 6*b* which present an alternative embodiment in side and bottom views, respectively. For ease of understanding the elements are given the same numerical designations as the corresponding elements in the prior embodiment. As shown in this embodiment the undercarriage is eliminated with magnet 11' serving the purpose of the omitted element as well as producing the magnetic field. Axles 6' and 9' are fastened to the bottom surface of magnet 11' with "Crazy Glue", a commercially available cyanoacrylate type glue, which provides a strong permanent bond. The cars wheels may extend out beyond the body so that the outer shape of the magnet may be a simple rectangular figure, eliminating the need for wheel well cut outs as in the embodiment of FIG. 1, previously described. The magnet in turn may be glued in place to the plastic body. As represented by the dash line 16 a central cutout may be made in the magnet as desired to reduce the weight of the entire assembly, such as where one wishes to more closely match the weight of a die cast iron toy car of like scale. This embodiment is simpler in structure than the former, although its fabrication departs from the standard manufacturing processes, enabled principally by the use of the modern cyanoacrylate type glue.

The symbolic illustrations of FIGS. *7a*, *7b* and *7c* present some of the effects accomplished. One may consider the car 12 being pushed slightly and approaching the front of car 14. At some point car 14 rolls backward to maintain some distance from car 12. A like effect occurs when car 14 is approached from the rear with car 14 in that instance rolling forward. When approached from the right or left side as illustrated in FIG. *7b*, car 12 stops a distance from car 14; car 14 remains static or, depending upon the frictional characteristics of the road surface slides to the side. It should be recognized that car 14 can be hurtled with such force as to overcome the repelling effect of the magnets and make contact, but that such mis-use of the car is not the normal mode of operation or play. As car 12 approaches from an angle toward the right front fender of car 14, as in FIG. *7c*, car 14 may turn slightly and roll backward, maintaining some distance to the moving oncoming car.

Figure 8:
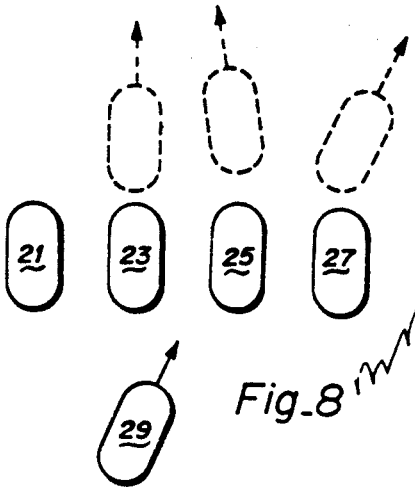

In a further example a group of the cars 21, 23, 25, and 27 are arranged in a line as illustrated in FIG. 8. Another vehicle 29 is pushed toward the line. As the propelled vehicle reaches a point near the other vehicles in which the magnetic lines of force repel, the line of vehicles literally scatters; one or more cars are moved and their magnetic fields in turn interact with fields of those adjacent cars as those cars move, effectively scattering the cars that is dramatic and exciting and demonstrates anti-collision properties.

Figure 9:
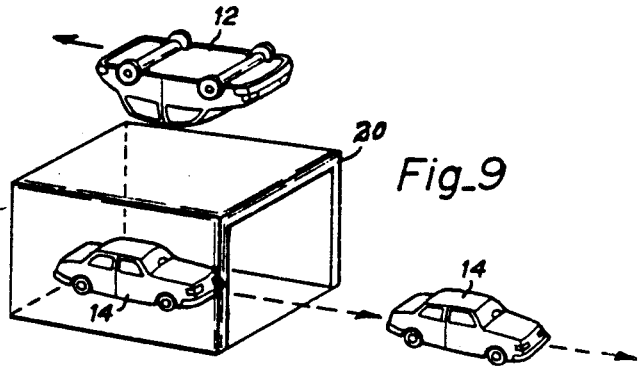
FIG. 9 illustrates a method of using the repelling effect of the invention as a motive force with cars in the playset

As depicted in the pictorial view of FIG. 9 with one car 14 concealed in a garage 20 of non magnetic material in which the automobile is facing an open doorway, a second car 12 taken in the palm of the hand and inverted so that the magnetic field of the latter is oppositely poled to that of the garaged car and moved slowly across the flat roof of the garage creates a repelling force that pushes the concealed car initially against the back wall of the garage. However, as the second hand carried vehicle progresses and moves further toward the back wall, the repelling force becomes oriented to repel the concealed vehicle in a forwardly direction, the fields essentially being reversed; and the concealed vehicle is literally propelled out of the garage doorway, and rolls fast and to a considerable distance due to the low friction wheel arrangement described. In one specific example of this action a "fast wheeled" car whose top was located approximately 3/16th inches below a flat plastic roof using the specific embodiment of FIG. 6 accelerated and moved out of the garage at an approximate speed of twelve inches per second, which scaled up to standard size cars represents perhaps 60 miles per hour, and traveled for a distance of thirteen inches on a smooth flat table top surface when the second car was slowly moved across the roof in the described manner. To miniaturized scale the car appeared to pull out of the garage with realistic effect.

It is believed that the foregoing description of the preferred embodiment of the invention is sufficient in detail to enable one skilled in the art to make and use the invention. However, it is expressly understood that the details of the elements which are presented for the foregoing enabling purpose are not intended to limit the scope of the invention, in as much as equivalents to those elements and other modifications thereof, all of which come within the scope of the invention, become apparent to those skilled in the art upon reading this specification. Thus the invention is to be broadly construed within the full scope of the appended claims.

What is claimed is:

1. The method of propelling a toy car through a doorway of an open toy garage, said garage including a roof, a back wall, and side walls, and said car being of the type that includes:

a hollow molded body portion, said body portion comprising a non-metal magnetically pervious material having a front and back ends, right and left sides and having a predetermined height and a predetermined weight;

a chassis portion for supporting said body portion; with said chassis containing front and back ends with said chassis being fitted within a bottom end of said body portion;

a first pair of low friction wheels and axle combination mounted at a first location to said chassis proximate a first end thereof and a second pair of low friction wheels and axle combination mounted to said chassis at a second location spaced from said first location proximate the other end of said chassis to permit relatively free rolling of said vehicle along a roadway surface; with said wheels being of non-metal magnetically pervious material;

permanent magnet means, said permanent magnet means being of a predetermined length, approximate that length of said body portion, width, approximate of that width of said body portion, and height, said permanent magnet means being disposed in said body portion with the length oriented with the length of said body portion, the width oriented in the width direction of said body portion and the height thereof being oriented in the height direction of said body portion; said height of said permanent magnet means being substantially lesser than the height of said body portion; said permanent magnet means including a first polarity magnetic pole on and covering the upper surface thereof and an opposite second polarity magnetic pole on and covering the bottom surface thereof to provide magnetic force lines that extend from the first polarity on the upper to the second polarity on the lower surface thereof, comprising the steps of:

placing the car in the garage in the proximity of or against the back wall and covered by said roof; and inverting and moving a second car of like construction to said garaged car by hand in a horizontal path over the roof of the garage in a direction from said doorway toward said back wall, whereby said garaged car rolls forwardly out the open garage door.

2. An improved children's toy car playset of the kind containing a plurality of wheeled toy cars for relatively free rolling movement on a roadway surface, in which one car on said roadway surface may be propelled and released to roll thereon toward at least a second car of said plurality at any angular position about a circle centered at said second car, the improvement comprising in combination therewith:

collision inhibiting means carried by each of said cars for inhibiting collisions between said one car and said second car, irrespective of the angle of approach of said one car to said second car; said collision inhibiting means comprising:

permanent magnet means located within each of said cars, each said permanent magnet means having a first pole on an upper surface and a second opposite pole on the bottom surface thereof for providing invisible magnetic field lines that extend from said first polarity pole to said second polarity pole on a lower surface thereof with said magnetic field lines extending beyond all sides of said toy car and with said field lines appearing all about the periphery of said associated car; whereby responsive to the one of said cars rolling to within a predetermined distance of said second car, the invisible magnetic field lines associated with said one of said toy cars interacts with the invisible magnetic field lines associated with said second car to create a repelling force therebetween.

3. The invention as defined in claim 2 wherein said permanent magnet means comprises:

a plastic binder containing granulated ferrite magnetic material.

4. The invention as defined in claim 2 wherein at least one of said cars includes a plastic body of a first predetermined weight, and a pair of low friction wheel and axle assemblies of a second predetermined weight, and wherein said permanent magnet means comprises a third predetermined weight at least as great as said first and second predetermined weights and wherein the overall weight and center of gravity thereof is essentially the same as that of a die cast metal toy car of approximate like size.

5. A toy vehicle playset containing at least two toy vehicles, each of said vehicles comprising:

a hollow body of magnetically pervious plastic material;

an elongate permanent magnet located in the bottom of said body;

said permanent magnet being of generally rectangular shape and of predetermined length, width and height, with said height being short relative to said length and width; said magnet being oriented within said body with one end located proximate the front end of said body, the opposite end located at the back end of said body and the width being fitted within the width of said body and the short height being oriented in the height direction of said body;

said permanent magnet being oriented with a first magnetic polarity on and covering the upper surface thereof and the second opposite magnetic polarity on and covering the bottom surface thereof to create magnetic lines of force extending through and about the outer surfaces of said body, which magnetic lines extend beyond the edges of said body; and wherein said body is of a weight that is less than the weight of said permanent magnet;

said magnet being located in the lower portion of said body to provide a low center of gravity to said vehicle;

a pair of axles coupled to said body;

first and second pairs of wheels mounted to one and the other axles, respectively, in said pair of axles; said axles being of a thin steel rod of approximately 0.028 inches in diameter, and said wheels having a tapered periphery to provide an easy rolling wheel axle arrangement to support said body;

whereby when one vehicle of said playset is moved toward another like vehicle of said playset from any position about the periphery of the latter vehicle a repelling force is created between such vehicles.

6. The invention as defined in claim 5 wherein said permanent magnet comprises a ferrite fixed in a vinyl binder to provide a flexible magnet.

7. The invention as defined in claim 5 wherein said permanent magnet comprises: molded ceramic material.

8. The invention as defined in claim 5 wherein said permanent magnet contains a hole for receiving a mounting post; and wherein said body includes a depending mounting post located within said body for insertion into said opening in said permanent magnet.

9. The invention as defined in claim 5 wherein said permanent magnet contains two cut out openings on each side thereof to provide clearance for said pairs of wheels.

10. A toy car comprising:

a hollow molded body portion, said body portion comprising a non-metal magnetically pervious material having a front and back ends, right and left sides and having a predetermined height and a predetermined weight;

a chassis portion for supporting said body portion; with said chassis containing front and back ends with said chassis being fitted within a bottom end of said body portion;

a first pair of low friction wheels and axle combination mounted at a first location to said chassis proximate a first end thereof and a second pair of low friction wheels and axle combination mounted to said chassis at a second location spaced from said first location proximate the other end of said chassis to permit relatively free rolling of said vehicle along a roadway surface; with said wheels being of non-metal magnetically pervious material;

permanent magnet means, said permanent magnet means being of a predetermined length, approximate that length of said body portion, width, approximate of that width of said body portion, and height, said permanent magnet means being disposed in said body portion with the length oriented with the length of said body portion, the width oriented in the width direction of said body portion and the height thereof being oriented in the height direction of said body portion; said height of said permanent magnet means being substantially lesser than the height of said body portion; said permanent magnet means including a first polarity magnetic pole on the upper surface thereof and an opposite second polarity magnetic pole on the bottom surface thereof to provide magnetic force lines that extend from the first polarity on the upper to the second polarity on the lower surface thereof with said magnetic field lines extending beyond all sides of said body.

11. The invention as defined in claim 10 wherein said chassis and said permanent magnet means comprises a homogenous unitary one piece assembly.

12. The invention as defined in claim 11 further including mounting means for mounting said axles to said chassis, with said mounting means comprising cyanoacrylate glue.

13. A toy car playset, which includes at least two toy cars for rolling upon a roadway surface, for simulating standard automotive vehicles equipped with anti-collision devices, said toy cars each comprising:

a hollow body portion of non-magnetic plastic material;

first and second sets of low friction wheel axle combinations, each of which sets include a relatively strong stiff cylindrical wire member having a diameter of 0.030 inches or lesser and a pair of wheels, each wheel having a simulated tread surface tapered frusta-conically for minimizing the area of contact with the roadway surface; and permanent bar magnet means having a first pole on an upper surface and a second opposite pole on the bottom surface thereof for providing magnetic force lines that extend from said first polarity pole to said second polarity pole on a lower surface thereof with said field lines extending beyond all sides of said body portion and with said field lines appearing all about the periphery of said body portion, whereby said magnetic field lines of one car may interact with the magnetic field lines of another car to create a repelling force therebetween;

said bar magnet means comprising a generally elongate rectangular geometry having a small height relative to its width and length mounted within and generally coextensive in area with the bottom of said hollow body portion with the top surface thereof facing away from the roadway surface and the bottom surface facing said roadway surface; said permanent bar magnet means being of a weight greater than the weight of said body portion to provide a low center of gravity to said toy car.

14. The invention as defined in claim 13 further comprising:

attaching means for attaching said axles to said permanent magnet means, said attaching means further comprising a cyanoacrylate based glue.

15. A toy car playset, which includes at least two toy cars for rolling upon a roadway surface, for simulating standard automotive vehicles equipped with anti-collision devices, said toy cars each comprising:

a hollow body portion of non-magnetic plastic material;

first and second sets of low friction wheel axle combinations, each of which sets include a relatively strong stiff cylindrical wire member having a diameter of 0.030 inches or lesser and a pair of wheels, each wheel having a simulated tread surface tapered frusta-conically for minimizing the area of contact with the roadway surface; and permanent bar magnet means having a first pole on an upper surface and a second opposite pole on the bottom surface thereof and producing a magnetic force of at least 1900 oersteds for providing magnetic force lines that extend from said first polarity pole to said second polarity pole on a lower surface thereof with said field lines extending through and beyond all sides of said body portion and with said field lines appearing all about the periphery of said body portion, whereby said magnetic field lines of one car may interact with the magnetic field lines of another car to create a repelling force therebetween;

said bar magnet means comprising a generally elongate rectangular geometry having a small height relative to its width and length mounted within and generally coextensive in area with the bottom of said hollow body portion with the top surface thereof facing away from the roadway surface and the bottom surface facing said roadway surface; said permanent bar magnet means being of a weight greater than the weight of said body portion and wherein the ratio of the weight of said permanent bar magnet means to the weight of said body portion and said wheel axle combinations is at least 1:1 to provide a low center of gravity to said toy car.

* * * * *